US005573423A

United States Patent [19]

Lin et al.

[11] Patent Number: 5,573,423

[45] Date of Patent: *Nov. 12, 1996

[54] INNOVATIVE DISTRIBUTION CABLE MOUNTING DEVICE

[76] Inventors: Kuang-Ts'an Lin; Shih-Tzung Liang, both of No. 360, Sec. 1, Min-Sheng N. Rd., Kuei-Shan Hsiang, Taoyuan County, Taiwan

[ * ] Notice: The term of this patent shall not extend beyond the expiration date of Pat. No. 5,362,253.

[21] Appl. No.: 374,120

[22] Filed: Jan. 18, 1995

[51] Int. Cl.[6] ..... H01R 13/58; H01R 4/38

[52] U.S. Cl. ..... 439/462; 439/805

[58] Field of Search ..... 439/461, 462, 439/805, 798, 449

[56] References Cited

U.S. PATENT DOCUMENTS

| | | | |
|---|---|---|---|
| 2,279,508 | 4/1942 | Bergan | 439/805 |
| 2,454,829 | 11/1948 | Neijstrom | 439/805 |
| 3,430,187 | 2/1969 | De Man et al. | 439/462 |
| 5,362,253 | 11/1994 | Lin et al. | 439/462 |

*Primary Examiner*—P. Austin Bradley
*Assistant Examiner*—Yong Kim
*Attorney, Agent, or Firm*—Morton J. Rosenberg; David I. Klein

[57] ABSTRACT

A distribution cable mounting device is provided. The cable mounting device includes a junction block which may be mounted on a cable distribution box. The junction block has a tapered junction hole with an internal thread. Also included is a hollow, tapered plug with longitudinal slits extending from both ends formed therein. Serrations are formed at one end of the through bore of the plug to secure the conductor when the plug is engaged within the tapered junction hole. A hollow screw member having an external thread formed at the front end thereof is threaded into the junction hole and stopped against the tapered plug, so as to tightly secure the insulator and conductor of the cable.

1 Claim, 6 Drawing Sheets

INNOVATIVE DISTRIBUTION CABLE MOUNTING DEVICE

BACKGROUND OF THE INVENTION

The present invention relates to an innovative distribution cable mounting device for fastening a distribution cable to a junction block of an electrical box. More particularly, the present invention is related to an improvement of the invention of U.S. Pat. No. 5,362,253.

The invention of U.S. Pat. No. 5,362,253, entitled Distribution Cable Mounting Device, is a very good system with five major component parts, namely a junction block, a tapered plug, a hollow screw member, a nut, and a cable with conductor. Nevertheless, its component parts are still comparatively complicated for practical use. Therefore, the present invention has been developed to provide a simplified cable mounting structure using fewer component parts.

SUMMARY OF THE INVENTION

The present invention provides an innovative distribution cable mounting device which eliminates the aforesaid disadvantage of the inventors' prior system.

According to the preferred embodiment of the present invention, the innovative distribution cable mounting device of the present invention is much less complicated than the system described in U.S. Pat. No. 5,362,253. The cable mounting device of the present invention comprises a junction block mounted inside an electrical box with a tapered junction hole having an internal thread formed on the wall of the hole. A hollow plug having a front and rear end with a tapered cone shape and parallel slits is formed therein. The hollow plug has formed raised serrations on the inner wall thereof. A hollow screw member is included for controlling the tightening of the cable by pushing the tapered plug into the junction hole. The front end of the hollow screw member has a conically shaped inner wall, and external screw threads are formed at the other end. The innovative distribution cable mounting device of the present invention functions almost the same as the device described in U.S. Pat. No. 5,362,253, but omits one component part, thereby decreasing production costs, facilitating assembly and disassembly, as well as being more convenient to use.

DETAILED DESCRIPTION OF THE PREFERRED EMBODIMENT

Figure 1:
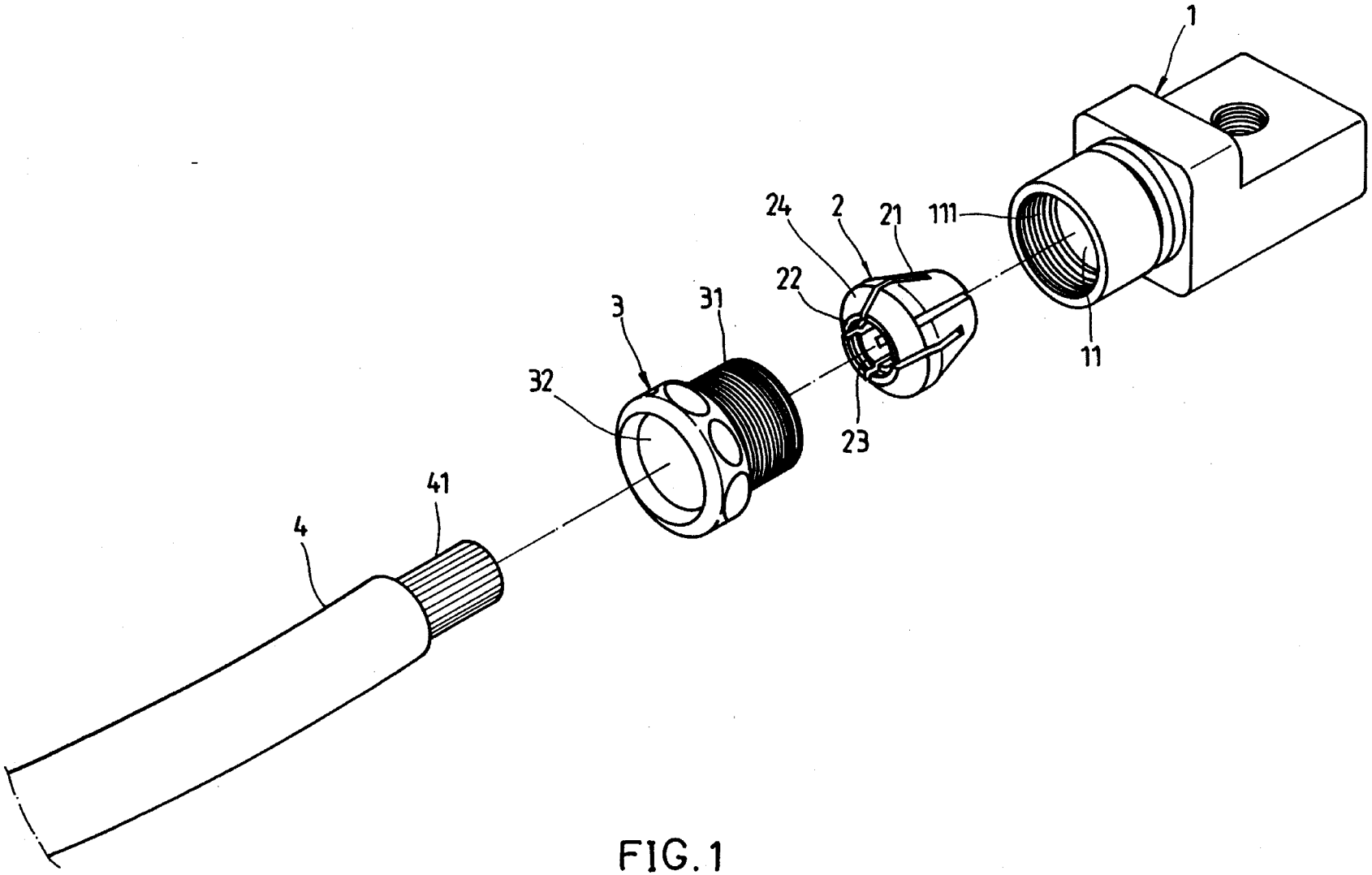
FIG. 1 is an exploded perspective view of the innovative distribution cable mounting device according to the preferred embodiment of the present invention.
Figure 2:
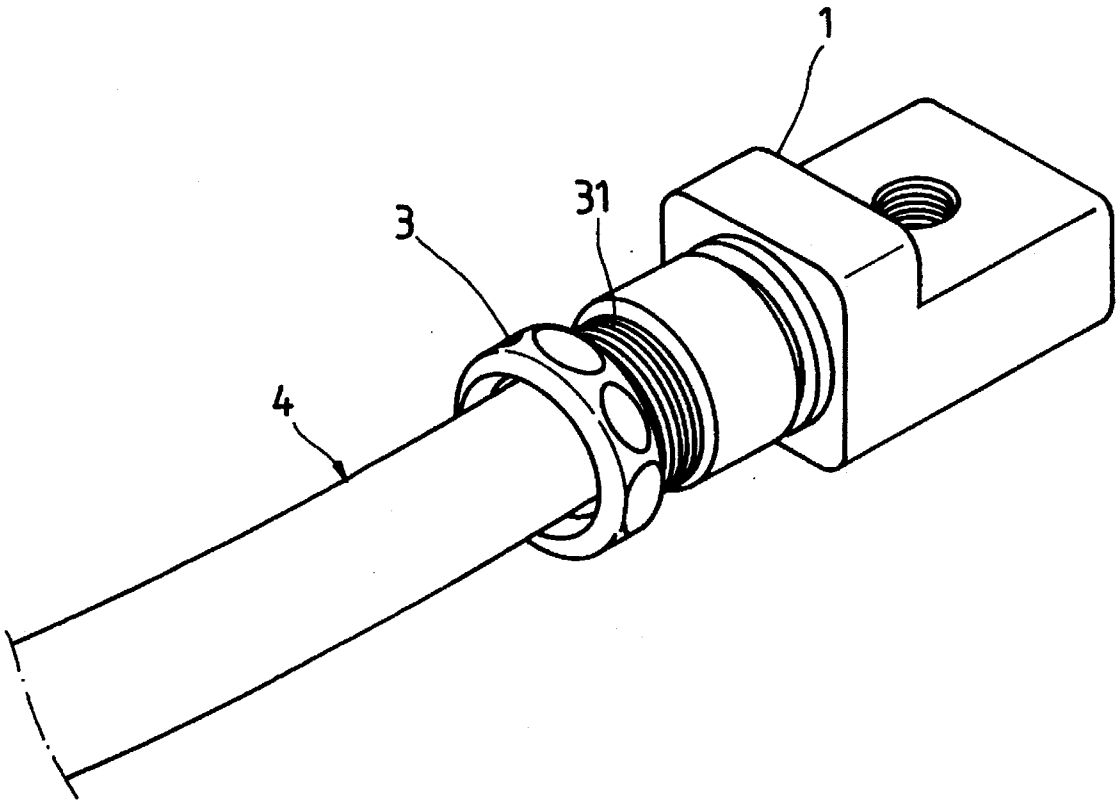
FIG. 2 is a perspective view of the assembled innovative distribution cable mounting device of FIG. 1.
Figure 3:
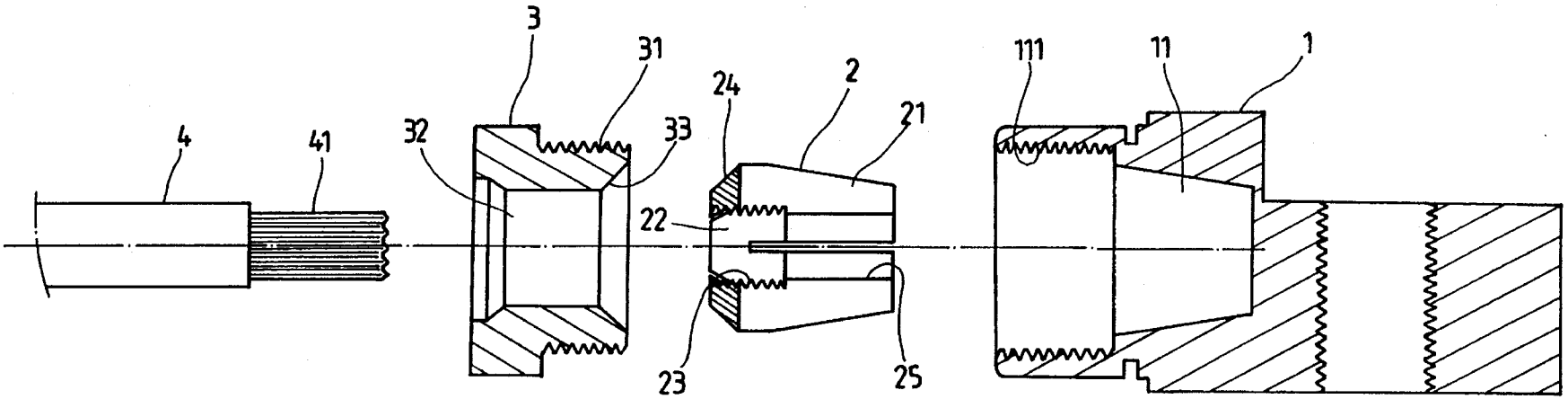
FIG. 3 is a cross-sectional view of the preferred embodiment of the innovative distribution cable mounting device.
Figure 4:
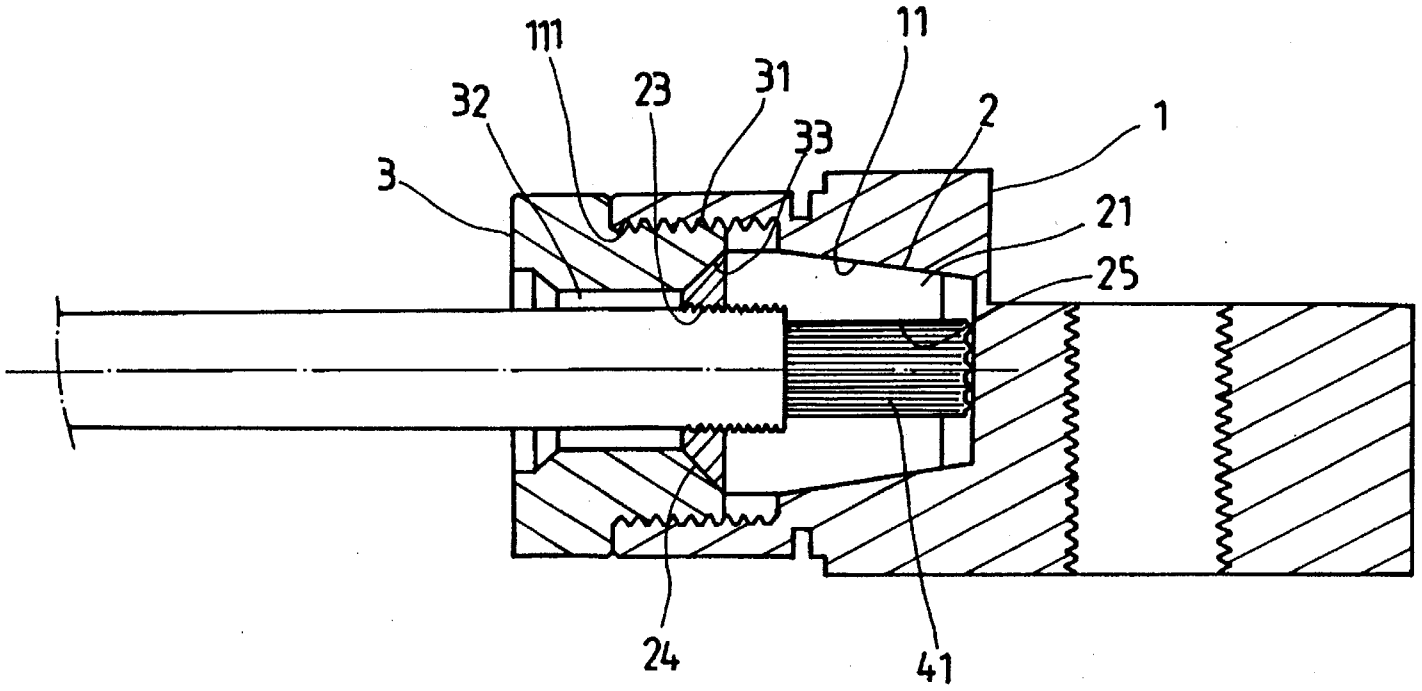
FIG. 4 is a cross-sectional view of the assembled innovative distribution cable mounting device.

Referring to FIGS. 1–4, junction block 1 has an internal thread 111 formed on an inner wall of a tapered junction hole 11. Further, there is shown, a hollow tapered plug 2 and a hollow screw member 3 disposed on the conductor 41 of cable 4.

The hollow tapered plug 2 has a longitudinal through hole 22, 25, but with the portion 22 being a different size than the portion 25. The back end of plug 2 has a tapered conical surface 24, and parallel slits 21 are formed to extend from ends thereof. The hollow screw member 3 has an external thread 31 formed on a front portion thereof. When the hollow screw member 3 is screwed into the junction hole 11 of junction block 1 to engage the internal thread 111, the hollow tapered plug 2 is pushed into junction hole 11 and the inner hole portion 25 is thereby squeezed and narrowed, so as to cramp the conductor 41 of cable 4.

Figure 5:
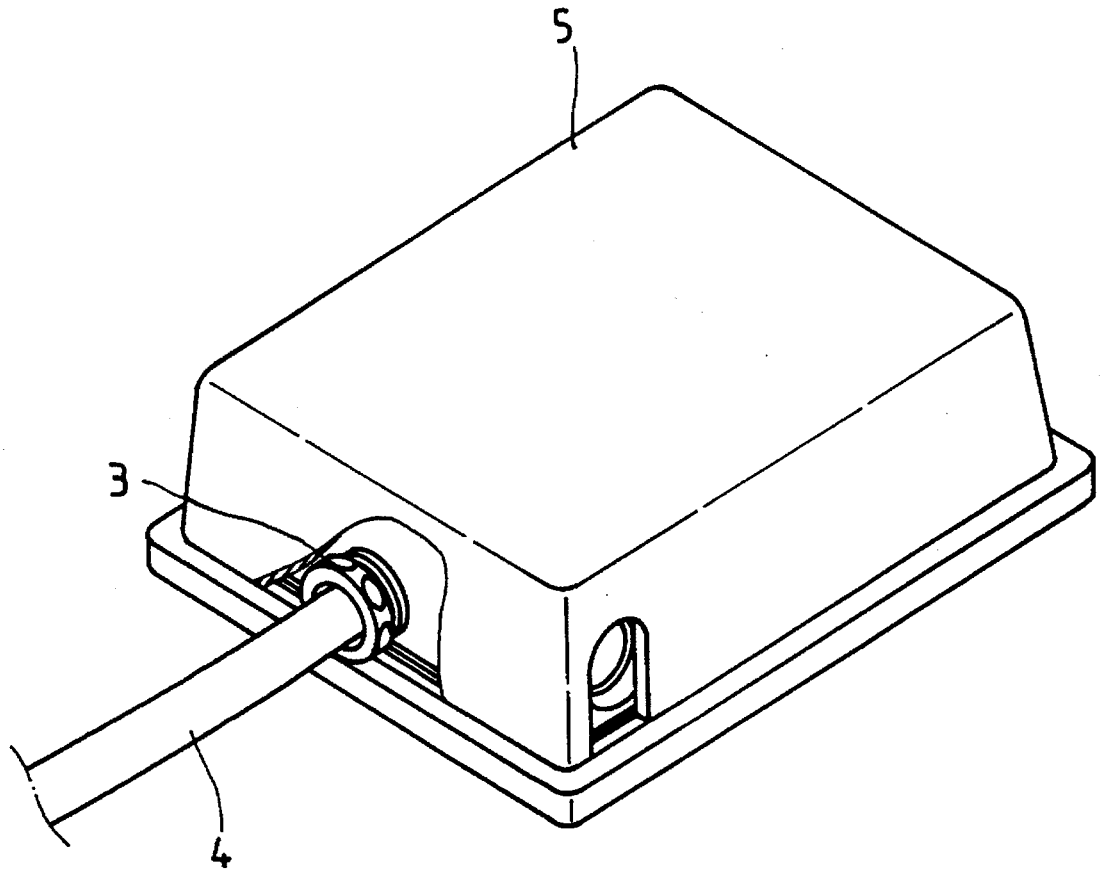
FIG. 5 is a perspective view showing the preferred embodiment of the innovative distribution cable mounting device assembled in a junction block.
Figure 6:
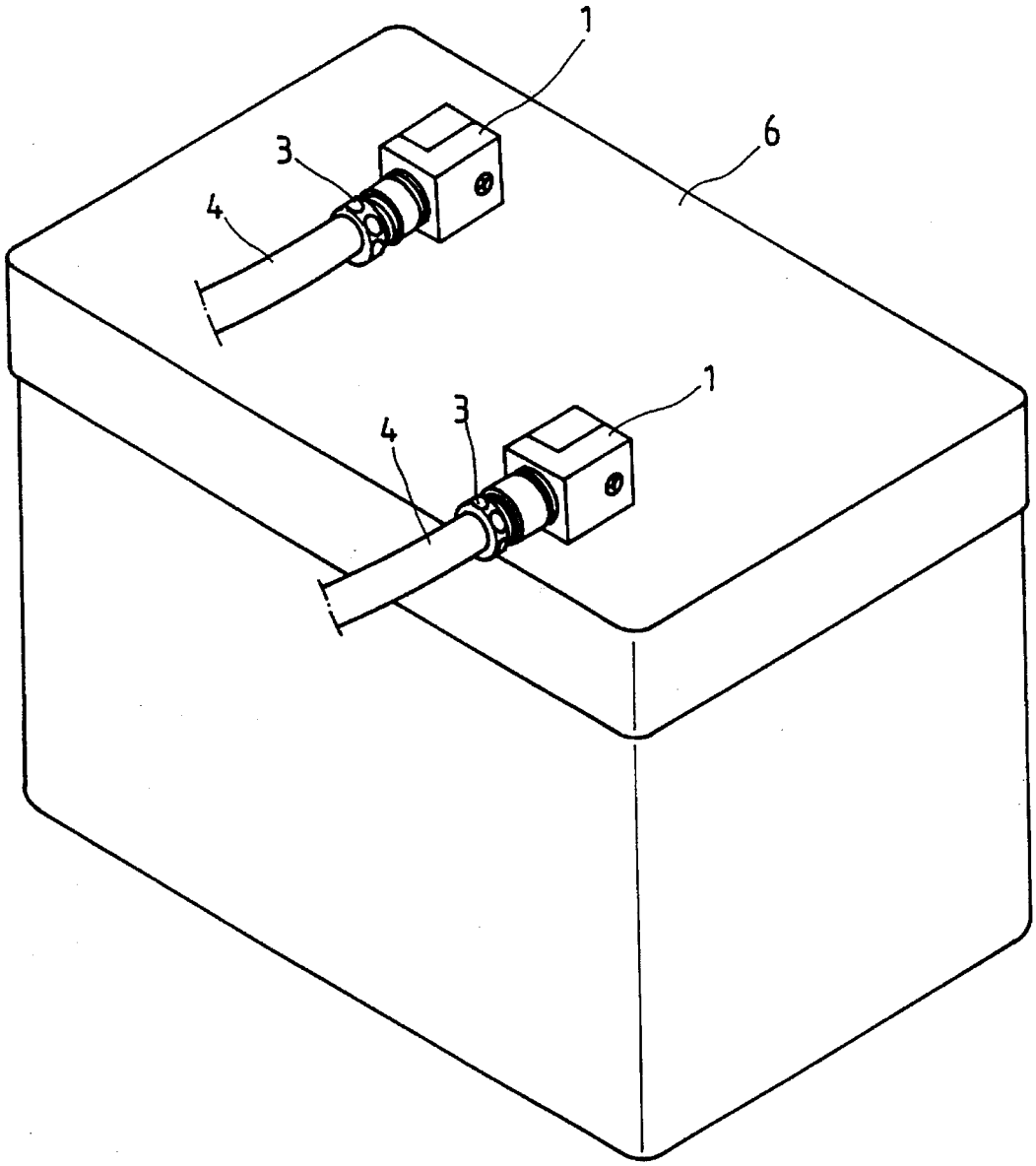
FIG. 6 is a perspective view showing the preferred embodiment of the innovative distribution cable mounting device used for connecting a battery.

When the hollow screw member 3 is screwed in continuously, the tapered surface 24 of the hollow tapered plug 2 is pushed in by the internal conical wall 33 at the front of hole 32 of hollow screw member 3. Such further causes the hole portions 22 and 25 to be reduced in size, so as to cause the insulator of the cable 4 as well as the conductor 41 to be tightly cramped. Raised serrations 23 are formed on the inner wall of hole portion 22. Thus, the innovative distribution cable mounting device becomes more simple to use than the system described in U.S. Pat. No. 5,362,253, and furthermore, it has wide use, such as on a cable distribution box 5, as shown in FIG. 5, or for coupling to a battery 6, as shown in FIG. 6.

As can be seen from the description of the embodiment of the innovative distribution cable mounting device, the present invention not only more tightly clamps the conductor 41 of cable 4, but also is more simple and less expensive to manufacture. Therefore, the innovative distribution cable mounting device is more practical and convenient to use.

What is claimed is:

1. An innovative distribution cable mounting device, comprising:

a longitudinally extended junction block, said junction block having a tapered junction hole formed longitudinally therein, said tapered junction hole having an internal thread formed therein;

a tapered plug member disposed within said tapered junction hole and having a pair of opposing first and second conically shaped tapered ends, said tapered plug member having a through bore extending between said first and second ends for receiving an electrical cable therein, said through bore being of a larger diameter at said first end than a diameter at said second end and having serrations formed on an inner wall surface of said through bore at said first end for engaging an insulative covering portion of the electrical cable, said diameter at said second end being adapted to receive a conductor portion of the electrical cable, said tapered plug member having a plurality of parallel spaced slits respectfully extending from said first and second ends thereof;

a longitudinally extended hollow screw member having a thread formed on an external surface of one end thereof for threaded engagement with said internal thread of said tapered junction hole, said hollow screw member having an inner wall surface defining a longitudinal opening extending therethrough for passage of the electrical cable into said tapered plug member, said inner wall surface having a conically shaped portion at said one end of said hollow screw member for engaging said first end of said tapered plug member as said engagement of said hollow screw member within said tapered junction hole is advanced to cause said first and second ends of said tapered plug member to clampingly engage respective insulative covering and conductor portions of the electrical cable.

* * * * *